US008419142B2

(12) United States Patent
Zimmermann

(10) Patent No.: US 8,419,142 B2
(45) Date of Patent: Apr. 16, 2013

(54) DRAWER GUIDE

(75) Inventor: Joachim Zimmermann, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 103 days.

(21) Appl. No.: 12/804,266

(22) Filed: Jul. 15, 2010

(65) Prior Publication Data

US 2011/0001412 A1 Jan. 6, 2011

Related U.S. Application Data

(63) Continuation of application No. PCT/EP2009/000975, filed on Feb. 12, 2009.

(30) Foreign Application Priority Data

Feb. 21, 2008 (DE) ..... 10 2008 011 481

(51) Int. Cl.
*A47B 88/04* (2006.01)

(52) U.S. Cl.
USPC ..... 312/333

(58) Field of Classification Search ..... 312/330.1, 312/333, 334.1, 334.7, 334.8, 334.11, 334.6, 312/334.44, 319.1; 384/21, 22
See application file for complete search history.

(56) References Cited

U.S. PATENT DOCUMENTS

| | | | | |
|---|---|---|---|---|
| 5,474,375 | A * | 12/1995 | Hollenstein et al. | 312/319.1 |
| 6,953,233 | B2 * | 10/2005 | Lam et al. | 312/333 |
| 7,533,946 | B2 * | 5/2009 | Hoffman | 312/333 |
| 7,854,485 | B2 * | 12/2010 | Berger | 312/333 |
| 2003/0234604 | A1 * | 12/2003 | Lin | 312/334.6 |
| 2004/0174101 | A1 | 9/2004 | Lin | |
| 2007/0126324 | A1 * | 6/2007 | Lee | 312/402 |

FOREIGN PATENT DOCUMENTS

| | | |
|---|---|---|
| EP | 1 561 398 | 8/2005 |

* cited by examiner

*Primary Examiner* — James O Hansen
(74) *Attorney, Agent, or Firm* — Lipsitz & McAllister, LLC

(57) ABSTRACT

In order to provide an at least three-rail drawer guide for guiding a drawer that can be withdrawn from a carcase, comprising an outer rail, at least one middle rail mounted on rolling bodies, an inner rail mounted on rolling bodies, and at least one damping apparatus, that takes up only a narrow installation space and enables a high load and/or a large withdrawal path, it is proposed that in the fully pushed-in state of the drawer guide at least one rolling body track of at least one middle rail is disposed at least partially between at least one damping apparatus and a rolling body track of the inner rail.

19 Claims, 9 Drawing Sheets

DRAWER GUIDE

RELATED APPLICATION

This application is a continuation of international application number PCT/EP2009/000975 filed Feb. 12, 2009, and claims the benefit of German Patent Application No. 10 2008 011 481.2 filed on Feb. 21, 2008, which are incorporated herein by reference in their entirety and for all purposes.

FIELD OF DISCLOSURE

The present invention relates to an at least three-rail drawer guide for guiding a drawer that can be withdrawn from a carcase, comprising an outer rail, at least one middle rail mounted on rolling bodies, an inner rail mounted on rolling bodies, and at least one damping apparatus.

BACKGROUND

Such drawer guides are known from the state of the art.

In the drawer guides known from the state of the art, the consequence of using a damping apparatus is either that a wider installation space is needed to install the drawer guide if the damping apparatus is not integrated into the rails of the drawer guide, or that the rails of the drawer guide are of a shortened construction and so the drawer guide has a lower load and/or a shorter withdrawal path if the damping apparatus is integrated into the rails.

SUMMARY OF THE INVENTION

The underlying object of the present invention is to provide a drawer guide of the initially described type that takes up only a narrow installation space and enables a high load and/or a large withdrawal path.

In a drawer guide having the features of the preamble of claim 1 this object is achieved according to the invention in that in the fully pushed-in state of the drawer guide at least one rolling body track of at least one middle rail is disposed at least partially between at least one damping apparatus and a rolling body track of the inner rail.

The solution according to the invention offers the advantage that the at least one middle rail may be of a particularly long construction. This guarantees a high load and/or a large withdrawal path. This further enables a space-saving arrangement of the damping apparatus on the drawer guide.

The drawer guide according to the invention offers the further advantage that only a narrow installation space is needed. By installation space is meant the space that is taken up by the drawer guide in the assembled state. In particular the overall width, i.e. the extent of the drawer guide in a direction which is at right angles to a withdrawal direction and which is horizontal in the assembled state of the drawer guide, is particularly low in the drawer guide according to the invention.

According to a development of the invention it is provided that all of the rolling body tracks of the at least one middle rail are of the same length. In this way a particularly high stability of the at least one middle rail is guaranteed. Furthermore, this makes it possible to use an identically constructed middle rail both in the left and in the right drawer guide of a pair of drawer guides.

In an advantageous form of construction of the invention it is provided that the drawer guide may be disposed completely between a side wall of the carcase and a side wall of the drawer to be withdrawn from the carcase. This enables a flexible arrangement of the drawer guide on a side wall of the carcase. In particular, the vertical position of the drawer guide is therefore not tied to the shape of the drawer.

It may preferably be provided that the outer rail is disposed on the carcase side and the inner rail on the drawer side. It is however also possible to dispose the outer rail on the drawer side and the inner rail on the carcase side.

It has proved particularly advantageous if in the assembled state of the drawer guide a plane extending substantially vertically and in withdrawal direction intersects all of the rolling body tracks of the drawer guide and the at least one damping apparatus. Particularly if all of the rolling body tracks of the drawer guide and the at least one damping apparatus in the assembled state of the drawer guide are disposed substantially one above the other, then in the event of loading of the drawer guide in the direction of gravitational force low torsional forces act upon the drawer guide, with the result that the drawer guide during operation is extensively distortion-free.

It is advantageous if the outer rail, the at least one middle rail or the inner rail have a—viewed in a direction at right angles to the withdrawal direction—substantially C-shaped cross section.

It is particularly advantageous if both the outer rail and the at least one middle rail and the inner rail have a substantially C-shaped cross section viewed in a direction at right angles to the withdrawal direction. This allows a nested and hence particularly compact arrangement of the rails relative to one another.

It has proved advantageous if at least one middle rail in the fully pushed-in state of the drawer guide is at least in sections surrounded on at least three sides by the outer rail. The at least one middle rail may therefore be guided in a particularly stable and space-saving manner on the outer rail of the drawer guide.

According to an advantageous form of construction of the invention the inner rail in the fully pushed-in state of the drawer guide is surrounded on at least three sides by the at least one middle rail. The inner rail may therefore be guided in a particularly stable and space-saving manner on the at least one middle rail.

According to a further advantageous form of construction of the invention it is provided that the drawer guide is configured as a full extension drawer guide. In this way the drawer guide has a particularly large withdrawal path, and the drawer may be withdrawn completely from the carcase.

In one form of construction of the invention it may be provided that the at least one damping apparatus is actuable by means of the inner rail. For this purpose an actuating element may be provided, which is used to actuate the at least one damping apparatus by means of the inner rail.

The movement damping by means of the damping apparatus may be realized for example by means of a movement damping fluid disposed in a housing of the damping apparatus, wherein the movement damping fluid comprises for example a gas or a gas mixture, in particular air.

Alternatively or in addition thereto, it may be provided that the movement damping fluid comprises a liquid, in particular an oil, silicone or the like.

In one form of construction of the invention it may be provided that the damping apparatus comprises two inner chambers, which are separated from one another by a piston and in which the movement damping fluid is disposed. The damping effect of the damping apparatus is then achieved in that the piston is displaced relative to the housing of the damping apparatus, for example by means of a piston rod. As a result, the volume of the inner chambers and the pressure prevailing therein varies, wherein the movement damping fluid because of the pressure difference flows for example through openings in the piston from the one inner chamber into the other inner chamber. The rate of flow is defined by the size of the openings in the piston and the viscosity of the movement damping fluid. As a result of the flow resistance, in particular because of the friction arising during the flow through the openings, and/or as a result of the friction between the piston and a boundary wall of a cylinder, which is provided in the housing of the damping apparatus and receives the piston, the movement of the piston and of the components acting on the piston is decelerated, and the kinetic energy of the piston and of the components acting on the piston is converted to thermal energy.

According to a development of the invention it may be provided that an actuating element for actuating the at least one damping apparatus by means of the inner rail is disposed in withdrawal direction behind the inner rail and, in the assembled state of the drawer guide, extends in a vertical direction, in particular in a direction parallel to a rail back that connects a top and a bottom limb of the inner rail, over substantially the entire height of the inner rail.

In one form of construction of the invention it may be provided that an actuating element for actuating the at least one damping apparatus by means of the inner rail takes the form of a web. By a "web" in the present description is meant an elongate thin element.

Preferably the at least one damping apparatus is disposed at least partially outside of the outer rail. The at least one middle rail and the inner rail may therefore be of a particularly long construction.

In a development of the invention it may be provided that the damping apparatus is disposed on a bottom edge of the drawer guide.

It may however alternatively be provided that the damping apparatus is disposed on a top edge of the drawer guide.

In a preferred configuration of the invention a pair of drawer guides may be provided, wherein one drawer guide is disposed at an—in withdrawal direction—left side of the drawer and the other drawer guide at an—in withdrawal direction—right side of the drawer.

In a development of the invention it may be provided that the damping apparatuses of the pair of drawer guides in the assembled state of the drawer guides are disposed mirror symmetrically to a longitudinal centre plane of the drawer that extends vertically and in the withdrawal direction.

It may however alternatively be provided that in the assembled state of the pair of drawer guides the damping apparatus of the one drawer guide is disposed on a top edge of the drawer guide and the damping apparatus of the other drawer guide is disposed on a bottom edge of the drawer guide.

According to a development of the invention it may be provided that in at least one of the rolling body tracks of the outer rail at least one cut-out is provided, through which an actuating element for actuating the at least one damping apparatus extends. The at least one damping apparatus disposed outside of the outer rail is therefore particularly easy to actuate without the actuating element having to extend around a rolling body track of the outer rail, which would lead to a widening of the drawer guide.

According to a development of the invention it may further be provided that the actuating element is displaceable along the cut-out. The at least one damping apparatus is therefore actuable by means of the actuating element particularly easily during pushing-in of the inner rail.

In one form of construction of the invention it may be provided that the actuating element comprises at least one—in withdrawal direction—front stop face, upon which the inner rail acts in order to actuate the at least one damping apparatus.

According to a development of this form of construction of the invention it is provided that the—in withdrawal direction—front stop face of the actuating element comprises an elastomer and/or a thermoplastic material. In this way, an impact of the inner rail upon the stop face of the actuating element may be damped, thereby enabling a particularly gentle actuation of the damping apparatus by means of the inner rail.

It may be provided that the drawer guide comprises a detent apparatus, by means of which the at least one damping apparatus and the inner rail may be releasably coupled to one another. The damping device may therefore be returned easily to its initial state in particular during withdrawal of the drawer guide.

According to a development of the invention it may be provided that the detent apparatus comprises a damper-side detent element and an inner-rail-side detent element, wherein a detent part of the damper-side detent element interacts with a control curve, which is disposed at a side of the detent part remote from the inner-rail-side detent element, and wherein the detent part of the damper-side detent element may be moved out of engagement with the inner-rail-side detent element by displacement of the damper-side detent element in withdrawal direction along the control curve. Such a detent apparatus in particular allows the damping apparatus to be returned to its initial state in a simple manner that is less susceptible to faults.

In a particularly preferred development of the invention it may be provided that the detent part of the damper-side detent element is biased towards the control curve.

The drawer guide preferably comprises a retraction apparatus for automatically retracting the drawer guide from an at least partially withdrawn state into the fully pushed-in state, wherein the retraction apparatus comprises at least one energy storage mechanism and at, least one driver that acts upon the at least one energy storage mechanism. Such a retraction apparatus guarantees that the drawer guide during pushing-in of the drawer always reaches the fully pushed-in end position.

It may advantageously be provided that the at least one driver and an actuating element for actuating the at least one damping apparatus are configured to be movable relative to one another during pushing-in and/or during withdrawal of the drawer guide in withdrawal direction.

According to a development of the invention it is provided that the at least one driver and an actuating element for actuating the at least one damping apparatus are configured to be movable relative to one another both during pushing-in and during withdrawal of the drawer guide in withdrawal direction. In this way, an uncoupling of the individual components from one another is guaranteed.

A preferred form of construction of the invention provides that during withdrawal of the drawer guide the at least one driver of the retraction apparatus is movable from the fully pushed-in position into a second position and is latchable in the second position.

In a development of the invention it is provided that during pushing-in of the drawer guide prior to an unlatching of the at least one driver the at least one damping apparatus is actuable by means of the inner rail. The actuation of the damping apparatus is therefore decoupled from the actuation of the at least one driver and hence the actuation of the drawer guide is less susceptible to faults.

A preferred form of construction of the invention provides that the at least one driver and an actuating element for actuating the at least one damping apparatus are designed to be movable relative to one another in a direction transversely of the withdrawal direction of the drawer guide during pushing-in and during withdrawal of the drawer guide. In this way a decoupling of the movement of the at least one driver and of the actuating element in a direction transversely of the withdrawal direction is guaranteed. In particular, this makes it possible during withdrawal of the drawer guide to move the driver transversely of the withdrawal direction into a detent position, in which the driver remains until it is unlatched by the pushing-in of the drawer guide.

According to an advantageous development of the invention it is provided that in the fully pushed-in state of the drawer guide at least one rolling body track of the at least one middle rail is disposed at least partially between the at least one damping apparatus and the retraction apparatus. Accordingly, a particularly long construction of the middle rail and a space-saving arrangement of the retraction apparatus and the damping apparatus on the drawer guide are possible.

In a development of the invention it is provided that the at least one damping apparatus, which is supported for example by means of at least one damper support, is pushed against and hence telescoped by an—in pushing-in direction—front side of the inner rail. Preferably, as a result of this telescoping the kinetic energy of the drawer during pushing-in is converted and the drawer is therefore decelerated.

The at least one damping apparatus device is preferably returned to its initial state, not by means of the at least one driver of the retraction apparatus, but by means of a separate detent apparatus.

According to a development of the invention it is provided that during withdrawal of the drawer guide from the fully pushed-in state the damping apparatus is displaceable by means of the separate detent apparatus from a first position into a second position, wherein the detent elements of the detent apparatus in the second position are movable out of engagement with one another and hence the damping apparatus despite further withdrawal of the drawer guide remains in the second position.

This form of construction has the advantage that the activation of the damping apparatus by means of the inner rail is independent of the function of the retraction apparatus, thereby permitting larger fitting tolerances between the position of the retraction apparatus and the position of the damping apparatus. The damping apparatus is therefore always reliably pulled along by the inner rail during withdrawal of the drawer guide.

In an advantageous form of construction of the invention it is provided that the at least one damping apparatus is disposed at least partially, preferably completely, outside of the drawer guide. It is thereby possible to prevent the at least one damping apparatus from being unintentionally actuated by means of the middle rail.

According to a development of the invention it is provided that on the at least one damping apparatus a damper-side detent element is disposed, which comprises a detent part designed in the form of a hammer. This detent part is preferably controlled during the pushing-in movement and/or the withdrawal movement by means of a curved path in a basic housing in such a way that it is movable at least temporarily into engagement with a hook of an inner-rail-side detent element.

Further features and advantages of the invention are the subject matter of the following description and graphical representation of an embodiment.

BRIEF DESCRIPTION OF THE DRAWINGS

In all of the figures identical or functionally equivalent elements are provided with the same reference characters.

DETAILED DESCRIPTION OF THE INVENTION

Figure 1:
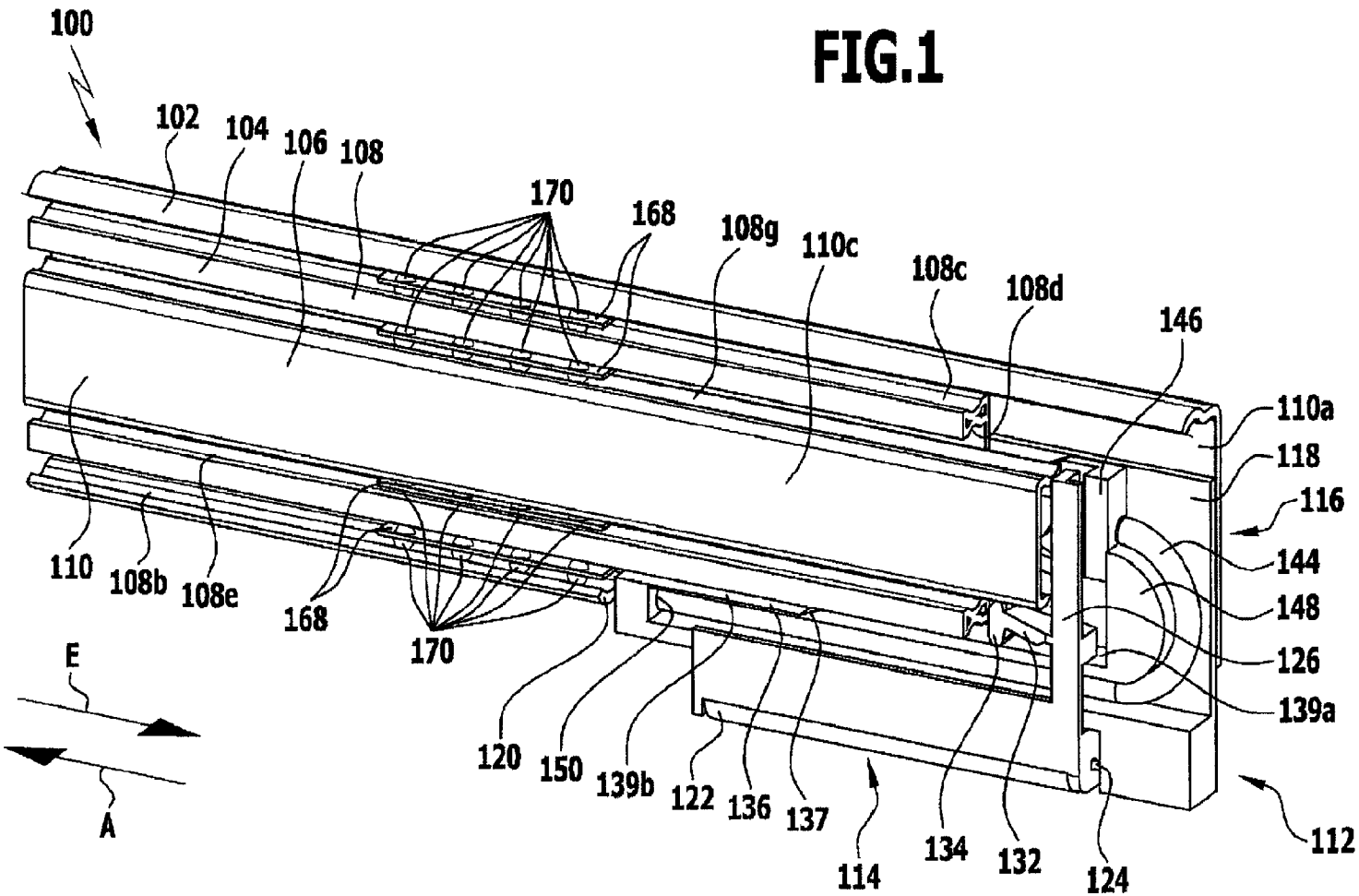
FIG. 1 a diagrammatic perspective view of a drawer guide according to the invention in a fully pushed-in state, viewed in the direction of an outer side of the inner rail of the drawer guide.

A drawer guide represented in FIGS. 1 to 9 and denoted as a whole by 100 comprises an outer rail 102, a middle rail 104 and an inner rail 106.

For example, the outer rail 102 may be disposed on the carcase side and the inner rail 106 may be disposed on the drawer side. It is however also possible to dispose the outer rail 102 on the drawer side and the inner rail 106 on the carcase side.

The outer rail 102, the middle rail 104 and the inner rail 106 each have a—viewed in a direction transversely of the withdrawal direction A-C-shaped cross section.

The outer rail 102, the middle rail 104 and the inner rail 106 comprise in each case a top and a bottom limb, which in the assembled state of the drawer guide 100 extend substantially horizontally and the surfaces of which are at least partially configured as rolling body tracks 108, and in each case a rail back 110, which connects the top and the bottom limb and in the assembled state of the drawer guide 100 extends substantially vertically (FIGS. 1 to 9).

By an inner side of the inner rail 106 is meant the side of a rail back 110*c* of the inner rail 106 at which the bottom and the top limb of the inner rail 106 are disposed.

By an outer side of the inner rail 106 is meant the side of the inner rail 106 remote from the inner side of the inner rail 106.

By an inner side of the middle rail 104 is meant the side of a rail back 110*b* of the middle rail 104 at which the bottom and the top limb of the middle rail 104 are disposed.

By an outer side of the middle rail 104 is meant the side of the middle rail 104 remote from the inner side of the middle rail 104.

The outer rail 102 comprises two rolling body tracks 108*a*, 108*b* that are disposed on mutually opposing faces of the top and the bottom limb of the outer rail 102.

The middle rail 104 comprises four rolling body tracks 108*c*, 108*d*, 108*e*, 108*f*, wherein two rolling body tracks 108*d*, 108*e* are disposed on mutually opposing faces of the top and the bottom limb of the middle rail 104 and two rolling body tracks 108*c*, 108*f* are disposed on mutually remote faces of the top and the bottom limb of the middle rail 104.

The inner rail 106 comprises two rolling body tracks 108*g* and 108*h*, which are disposed on mutually remote faces of the top and the bottom limb of the inner rail 106.

The drawer guide 100 further comprises rolling bodies 170 which take the form of spherical rolling bodies 170 and are held in a rolling body cage 168 (FIG. 1).

Such rolling bodies 170 are disposed between the rolling body track 108*a* of the outer rail 102 and the rolling body track 108*c* of the middle rail 104 as well as between the rolling body track 108*b* of the outer rail 102 and the rolling body track 108*f* of the middle rail 104 in order to enable guided movement of the middle rail 104 on the outer rail 102.

Such rolling bodies 170 are further disposed between the rolling body track 108*d* of the middle rail 104 and the rolling body track 108*g* of the inner rail 106 as well as between the rolling body track 108*e* of the middle rail 104 and the rolling body track 108*h* of the inner rail 106 in order to enable guided movement of the inner rail 106 on the middle rail 104.

The inner rail 106 is disposed on the middle rail 104 in such a way that in the fully pushed-in state of the drawer guide 100 the middle rail 104 surrounds the inner rail 106 on three sides, namely at the top, at the bottom and at the inner side of the inner rail 106, wherein the rail back 110*c* of the inner rail 106 is disposed remote from the rail back 110*b* of the middle rail 104.

The middle rail 104 is disposed on the outer rail 102 in such a way that in the fully pushed-in state of the drawer guide 100 the outer rail 102 surrounds at least one—in the withdrawal direction A—front portion of the middle rail 104 on three sides, namely at the top, at the bottom and at the outer side of the middle rail 104, wherein the rail back 110*b* of the middle rail 104 is disposed facing the rail back 110*a* of the outer rail 102.

In the region of the drawer guide 100 that in a withdrawal direction A, along which the inner rail 106 and the middle rail 104 are withdrawable relative to the outer rail 102, lies at the rear, a combined retraction and damping device 112 is disposed. The retraction and damping device 112 comprises a damping apparatus 114 and a retraction apparatus 116.

The retraction and damping device 112 comprises a plate in the form of guide plate 118 and is disposed with said plate on the inner side of the rail back 110*a* of the outer rail 102, wherein in the bottom limb of the outer rail 102 and hence also in the rolling body track 108*b* of the outer rail 102 a cut-out 120 is provided, through which the retraction and damping device 112 extends.

In this embodiment the damping apparatus 114 comprises a housing 122 and a piston, which is not shown in the drawings and on which a piston rod 124 projecting into the housing 122 is disposed, wherein both the housing 122 and the piston rod 124 of the damping apparatus 114 are disposed outside of the outer rail 102, in the assembled state of the drawer guide 100 below the outer rail 102. The piston rod 124 of the damping apparatus 114 is connected in a fixed manner to the guide plate 118 disposed on the outer rail 102.

The damping apparatus 114 further comprises two inner chambers, which are separated from one another by means of the piston and in which a movement damping fluid, for example air, is disposed. The damping effect of the damping apparatus 114 is achieved in that the piston is displaced relative to the housing 122 by means of the piston rod 124.

In a non-illustrated form of construction of the invention it may be provided that the housing 122 of the damping apparatus 114 is connected in a fixed manner to the guide plate 118 and the piston rod 124 is designed to be movable relative to the housing 122 in the withdrawal direction A or counter to the withdrawal direction A, i.e. in the pushing-in direction E.

For displacing the housing 122 of the damping apparatus 114 by means of the inner rail 106, in the present embodiment an actuating element 126, which takes the form of a web, is provided.

The actuating element 126 for actuating the damping apparatus 114 is disposed on the—in withdrawal direction A—rear end of the housing 122 of the damping apparatus 114. This allows the actuating element 126 during pushing-in of the drawer guide 100 to be displaced by means of the inner rail 106 far into an—in withdrawal direction A—rear region of the drawer guide 100. The damping apparatus 114 with the actuating element 126 in this case takes up only very little space. The middle rail 104 and the inner rail 106 may therefore be of a particularly long construction, thereby enabling a large withdrawal path and/or a particularly high load of the drawer guide 100.

The actuating element 126 has an—in withdrawal direction A—front stop face 130, upon which the inner rail may act with its—in withdrawal direction A—rear end. The stop face 130 of the actuating element 126 is formed from a material that comprises an elastomer or a thermoplastic material.

The actuating element 126 for actuating the damping apparatus 114 further comprises a damper-side detent element 132 designed in the form of a hammer and having a detent part 134. The detent part 134 of the damper-side detent element 132 is preloaded by the elasticity of shape of the damper-side detent element 132 towards a control curve 136 and is movable upon displacement in the withdrawal direction A along the control curve 136 in a direction transversely of the withdrawal direction A.

The control curve 136 comprises a ramp 137 and two portions 139*a*, 139*b*, which are connected by means of the ramp 137, extend parallel to the withdrawal direction A and in the assembled state of the drawer guide 100 are oriented horizontally, wherein the portion 139*a* is arranged offset towards the inner-rail-side detent element 138 and the portion 139*b* is arranged offset away from the inner-rail-side detent element 138.

The portion 139*a* of the control curve 136 that is offset towards the inner-rail-side detent element 138 is disposed—in the pushing-in direction E—in front of the portion 139*b* that is offset away from the inner-rail-side detent element 138.

The ramp 137 of the control curve 136 is a section of the control curve 136 that extends obliquely between the horizontal portions 139*a*, 139*b*.

The control curve 136 is consequently formed in such a way that the damper-side detent element 132 in the fully pushed-in state of the drawer guide 100 is biased in the direction of the inner-rail-side detent element 138 by means of the portion 139*a* of the control curve 136 that is offset towards the inner-rail-side detent element 138.

The inner-rail-side detent element 138 is provided on a control element 140, which is disposed on the inner rail 106.

The inner-rail-side detent element 138 is configured to yield in a direction transversely of the withdrawal direction A so that the inner-rail-side detent element 138 may be guided past the damper-side detent element 132 in the pushing-in direction E even when the damper-side detent element 132 is in a position, in which the damper-side detent element 132 during normal operation of the drawer guide 100 is in engagement with the inner-rail-side detent element 138.

In the fully pushed-in state of the drawer guide 100 the damper-side detent element 132 is in engagement with the inner-rail-side detent element 138 during normal operation of the drawer guide 100. The damper-side detent element 132 and the inner-rail-side detent element 138 together form a detent apparatus 142 that enables a releasable coupling between the damping apparatus 114 and the inner rail 106.

The retraction apparatus 116 comprises an energy storage mechanism 144 designed for example as a spring, in particular a tension spring, as well as a driver 146, upon which the energy storage mechanism 144 acts.

The energy storage mechanism 144 is guided by means of a deflection apparatus 148, which is disposed by means of the guide plate 118 in vertical direction substantially centrally and in the pushing-in direction E on the front end of the rail back 110*a* of the outer rail 102, and extends from a fastening apparatus 150, which is disposed on an—in withdrawal direction A—front end of the guide plate 118 and adjacent to an—in withdrawal direction A—front end of the cut-out 120 in the bottom limb of the outer rail 102, initially in the pushing-in direction E and after deflection by means of the deflection apparatus 148 substantially in the withdrawal direction A up to the driver 146.

Figure 2:
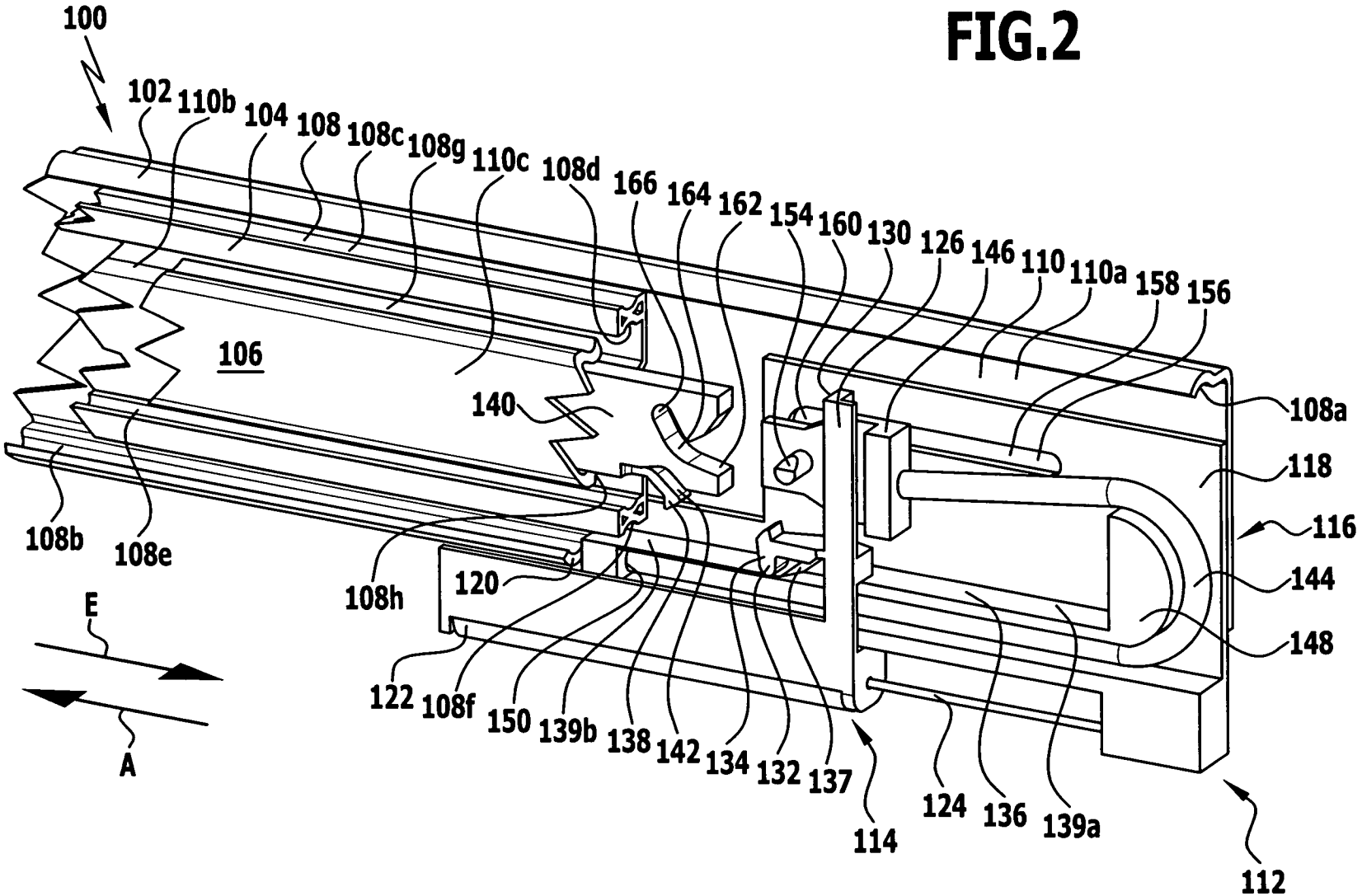
FIG. 2 a diagrammatic perspective view of the—in withdrawal direction—rear region of the drawer guide of FIG. 1 in a partially withdrawn state, viewed in the direction of the outer side of the inner rail of the drawer guide.
Figure 3:
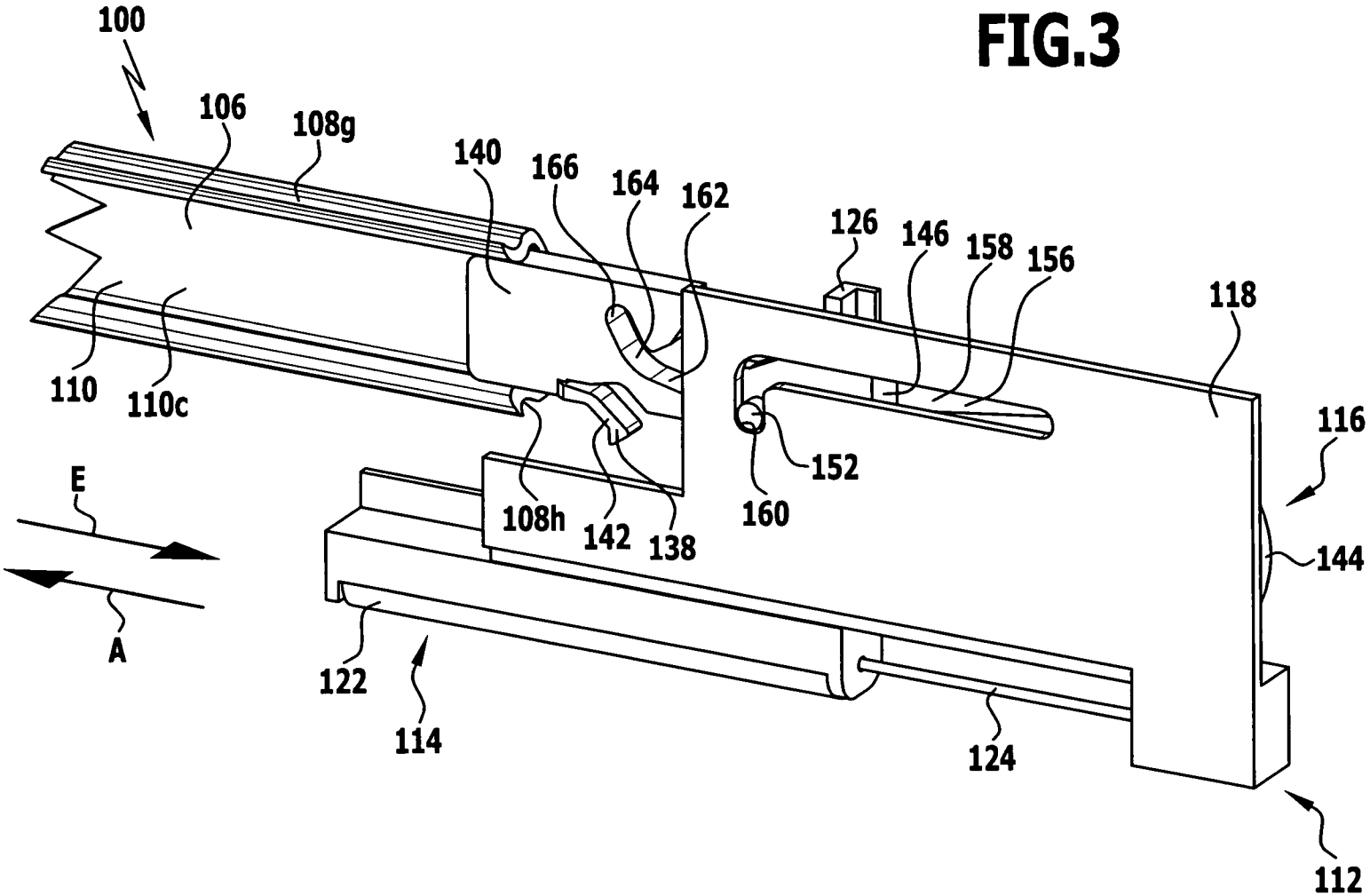
FIG. 3 a diagrammatic perspective view of the—in withdrawal direction—rear region of the drawer guide of FIG. 1 in the partially withdrawn state, viewed in the direction of an inner side of the inner rail of the drawer guide, wherein for greater clarity the outer rail and the middle rail are not shown.
Figure 4:
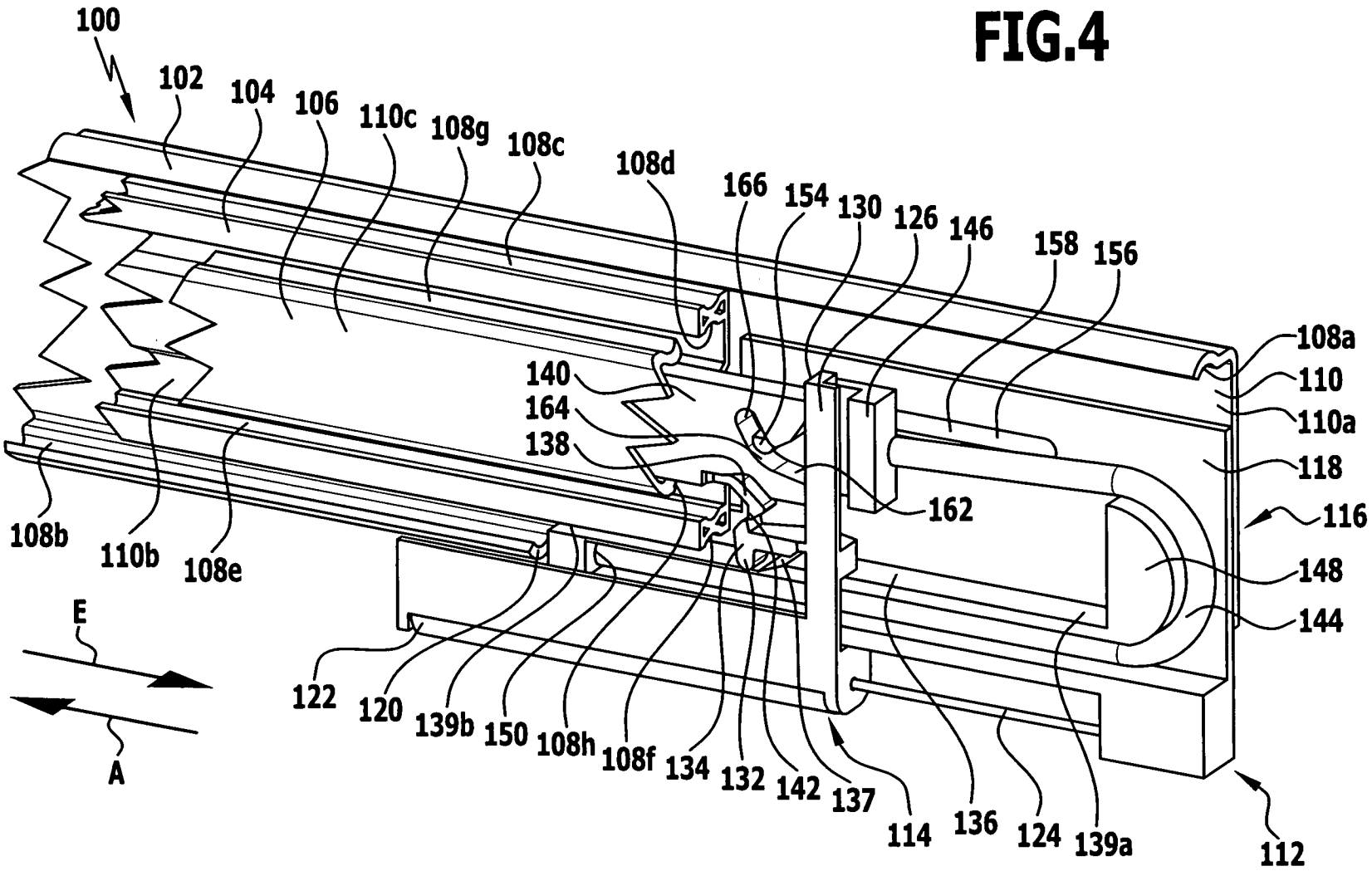
FIG. 4 a diagrammatic perspective view of the—in withdrawal direction—rear region of the drawer guide of FIG. 1 in a state of pushing-in up to actuation of a retraction apparatus, viewed in the direction of the outer side of the inner rail of the drawer guide.
Figure 5:
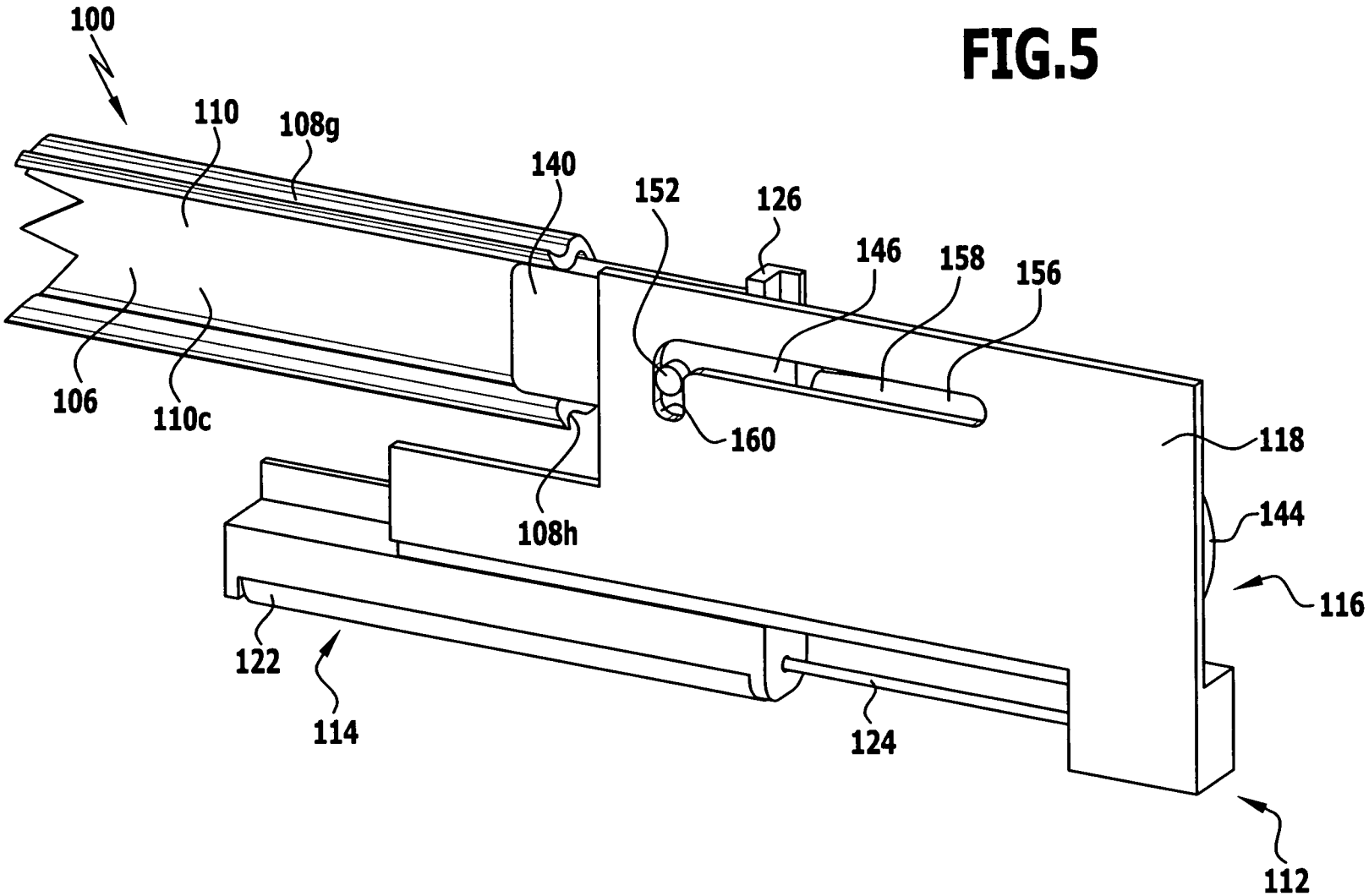
FIG. 5 a diagrammatic perspective view of the—in withdrawal direction—rear region of the drawer guide of FIG. 1 in the state of pushing-in up to the actuation of the retraction apparatus, viewed in the direction of the inner side of the inner rail of the drawer guide, wherein for greater clarity the outer rail and the middle rail are not shown.
Figure 6:
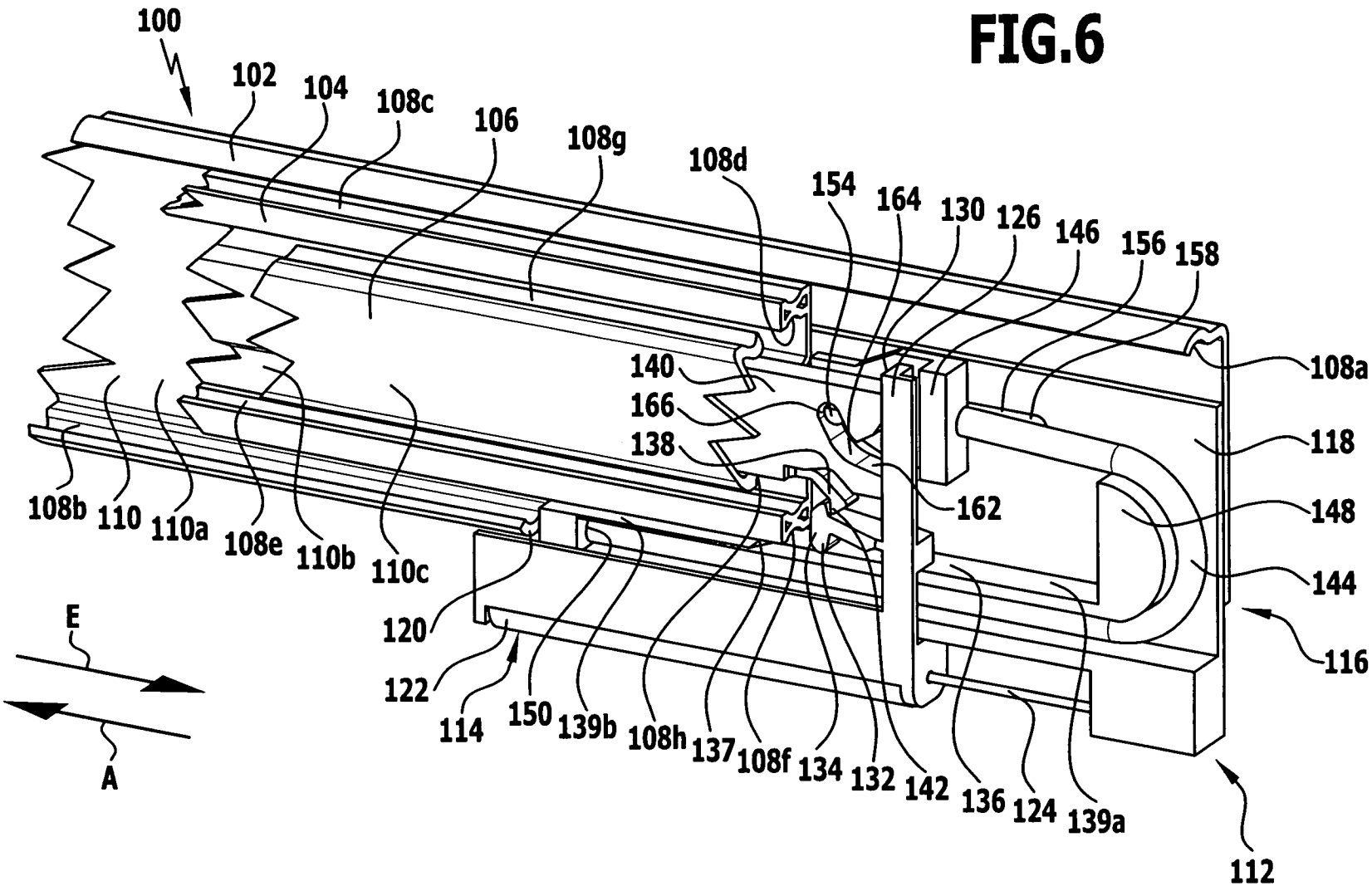
FIG. 6 a diagrammatic perspective view of the—in withdrawal direction—rear region of the drawer guide of FIG. 1 in a state of being partially retracted by means of the retraction apparatus, viewed in the direction of the outer side of the inner rail of the drawer guide.
Figure 7:
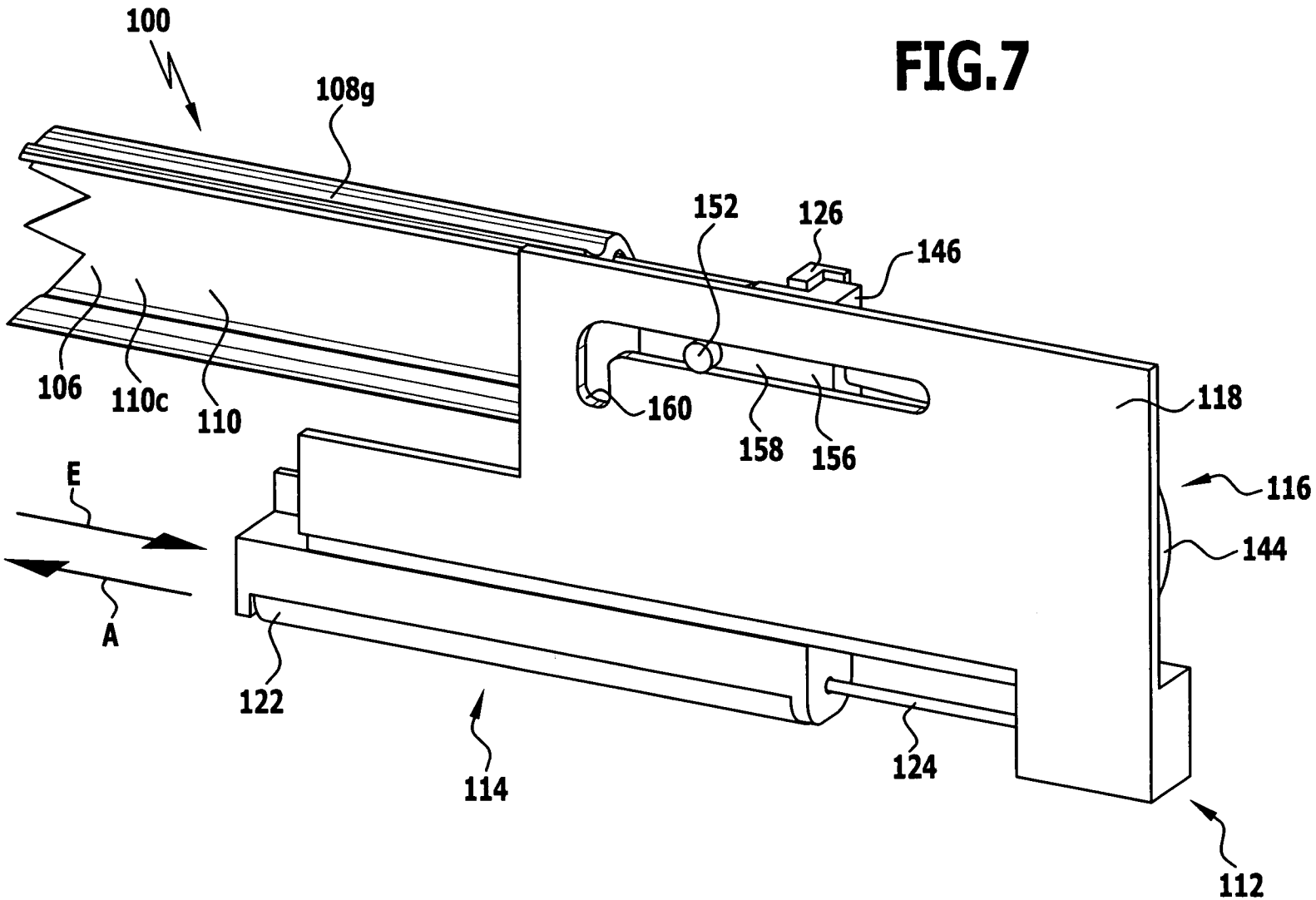
FIG. 7 a diagrammatic perspective view of the—in withdrawal direction—rear region of the drawer guide of FIG. 1 in the state of being partially retracted by means of the retraction apparatus, viewed in the direction of the inner side of the inner rail of the drawer guide, wherein for greater clarity the outer rail and the middle rail are not shown.

The driver 146 comprises a guide pin 152 facing the outer rail and illustrated in FIGS. 3, 5 and 7 as well as a driver pin 154 facing the inner rail and illustrated in FIGS. 2, 4 and 6. The guide pin 152 is guided in a guide channel 156 of the guide plate 118. The guide channel 156 is subdivided into a guide portion 158, which in the assembled state of the drawer guide 100 extends horizontally, and a detent portion 160, which extends at the—in withdrawal direction A—front end of the guide portion 158 transversely relative thereto, in the assembled state of the drawer guide 100 for example vertically downwards.

By means of the guide pin 152 the driver 146 is movable in a guided manner in the withdrawal direction A along the guide portion 158 and then transversely of the withdrawal direction A along the detent portion 160.

As the force exerted by means of the energy storage mechanism 144 on the driver 146 acts substantially parallel to the pushing-in direction E, the driver 146 may be brought into a detent position by displacement of the guide pin 152 into the detent portion 160 of the guide channel 156 (FIGS. 2 and 3).

The driver 146 is actuable by means of the control element 140, which is disposed on the inner rail 106. The control element 140 comprises a run-in portion 162, a control channel 164 and an end portion 166.

The previously described drawer guide 100 operates as follows:

During pushing-in of the drawer guide 100 from the fully withdrawn state (FIGS. 2 and 3), the inner rail 106 is moved relative to the outer rail 102 and relative to the middle rail 104 towards the retraction and damping apparatus 112 disposed on the—in pushing-in direction E—front end of the outer rail 102, until the—in the pushing-in direction E—front end of the inner rail 106 acts upon the stop face 130 of the actuating element 126.

As a result, during further pushing-in of the drawer guide 100 the housing 122 of the damping apparatus 114 is displaced in the pushing-in direction E.

As a result of this displacement of the housing 122 of the damping apparatus 114 in the pushing-in direction E, the volume of the two inner chambers of the housing 122 and the pressure prevailing in each of these inner chambers varies, wherein the movement damping fluid because of the pressure difference flows for example through openings in the piston from the one inner chamber into the other inner chamber. The rate of flow is defined by the size of the openings in the piston and the viscosity of the movement damping fluid. As a result of the friction arising during the flow through the openings, the kinetic energy of the inner rail 106 and of the drawer disposed thereon is converted to thermal energy. A pushing-in movement of the drawer guide 100 is consequently decelerated.

The actuation of the damping apparatus 114 is effected preferably after the start of actuation of the retraction apparatus 116.

During pushing-in of the inner rail 106 the driver 146 is actuated by means of the control element 140 in that the driver pin 154 of the driver 146 is received by means of the run-in portion 162 in the control element 140 and guided along the control channel 164 into the end portion 166 of the control element 140 (FIGS. 4 and 5). By virtue of the shape of the control channel 164 and the end portion 166 of the control element 140, during normal operation during pushing-in of the drawer guide 100 the driver 146, which is then disposed in the detent position, is unlatched from this detent position by means of the control element 140. The driver pin 154 of the driver 146 is then situated in an end portion 166 of the control element 140 (FIGS. 6 and 7).

Figure 8:
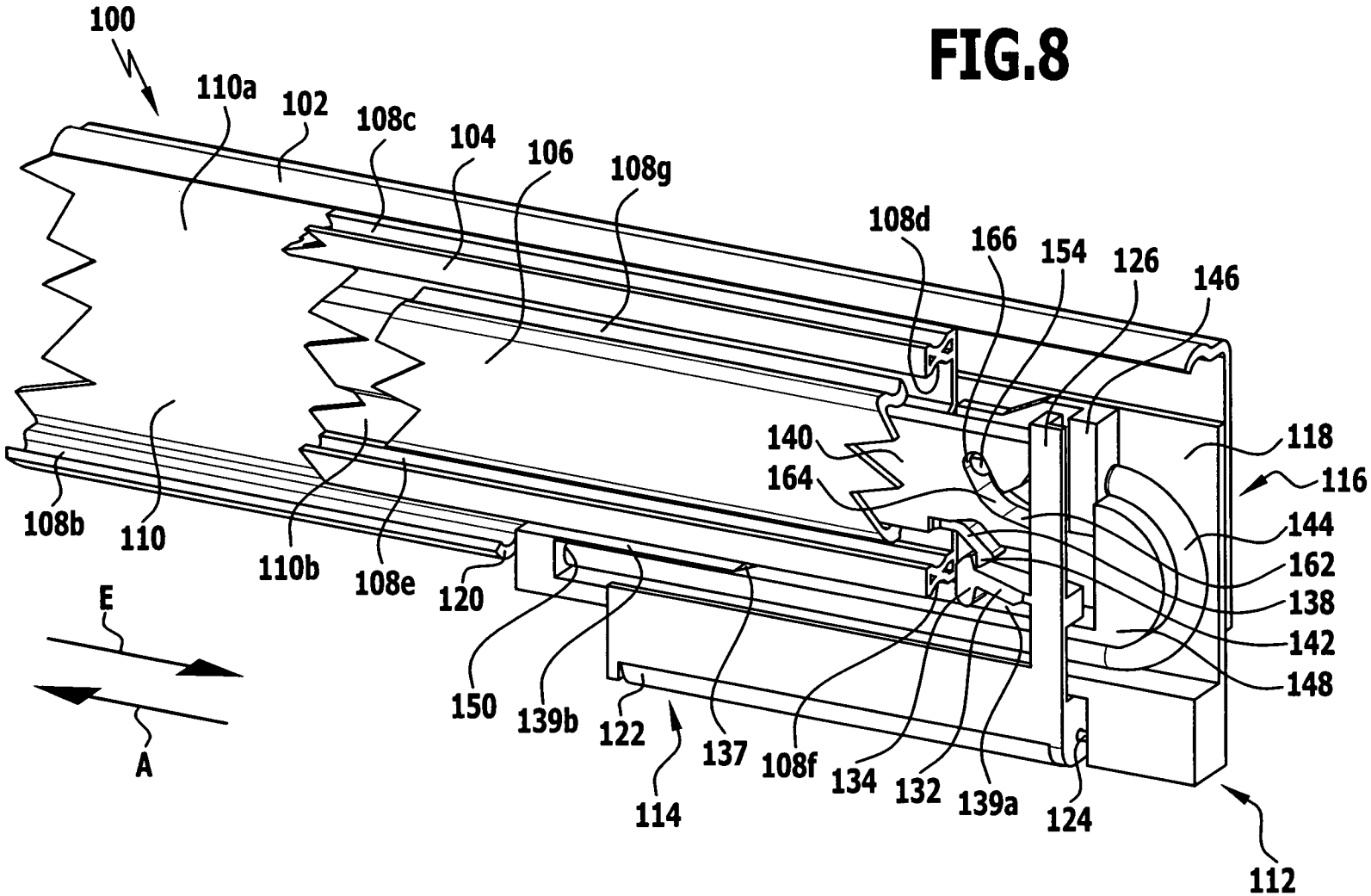
FIG. 8 a diagrammatic perspective view of the—in withdrawal direction—rear region of the drawer guide of FIG. 1 in the fully pushed-in state, viewed in the direction of the outer side of the inner rail of the drawer guide.
Figure 9:
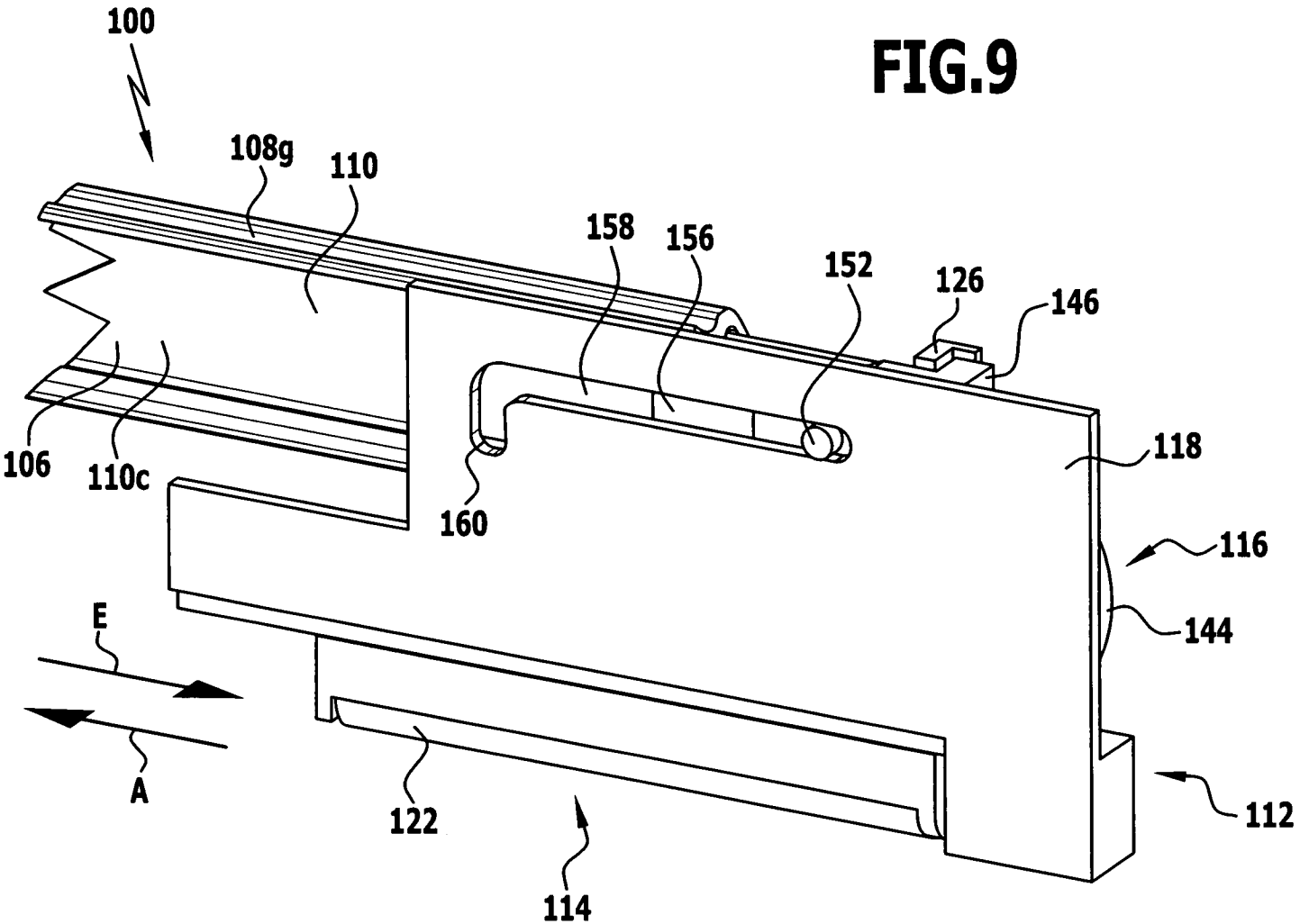
FIG. 9 a diagrammatic perspective view of the—in withdrawal direction—rear region of the drawer guide of FIG. 1 in the fully pushed-in state, viewed in the direction of the inner side of the inner rail of the drawer guide, wherein for greater clarity the outer rail and the middle rail are not shown.

Because of the force that is exerted by means of the energy storage mechanism 144 on the driver 146 in the pushing-in direction E, both the driver 146 and the inner rail 106, which is latched to the driver 146 by means of the driver pin 154 and the control element 140, are pulled from the detent position into the fully pushed-in position of the drawer guide 100 (FIGS. 1, 8 and 9).

The actuation of the damping apparatus 114 by means of the actuating element 126 is effected in this case only by displacement of the inner rail 106. During this process, the driver 146 and the actuating element 126 do not come into contact with one another.

During withdrawal of the drawer guide 100 from the fully pushed-in state, a restoring of the initial state of the damping apparatus 114 is effected by displacement of the housing 122 relative to the piston rod 124 in the withdrawal direction A by means of the detent apparatus 142.

During withdrawal of the inner rail 106 the housing 122 of the damping apparatus 114 is moved by means of the detent apparatus 142 from a first position, in which the piston rod

124 is pushed-in to the maximum extent into the housing 122, into a second position, in which the piston rod 124 is withdrawn to the maximum extent from the housing 122, wherein in the second position the damper-side detent element 132 comes out of engagement with the inner-rail-side detent element 138, with the result that the housing 122 of the damping apparatus 114 despite further withdrawal of the inner rail 106 remains in the second position.

Specifically, the detent apparatus 142 in this case operates in such a way that as a result of displacement of the damper-side detent element 132 of the drawer guide 100 in the withdrawal direction A the detent part 134 is displaced along the control curve 136 and hence initially horizontally along the portion 139*a* of the control curve 136 that is offset towards the inner-rail-side detent element 138. As a result of further displacement of the damper-side detent element 132 in the withdrawal direction A the detent part 134 because of its preloading is then moved along the ramp 137 of the control curve 136 and hence during the movement in the withdrawal direction A also at right angles thereto vertically downwards away from the inner-rail-side detent element 138 and is therefore brought out of engagement with the inner-rail-side detent element 138 (FIGS. 2 and 4).

During withdrawal of the drawer guide 100 from the fully pushed-in state the retraction apparatus 116 is therefore returned to its initial state in that the driver 146 by means of the driver pin 154, which is situated in the end portion 166 of the control element 140, is displaced along the guide channel 156 as a result of withdrawal of the inner rail 106. At the end of the guide portion 158 of the guide channel 156 the movement of the driver 146 in the withdrawal direction A is stopped and because of the shape of the control element 140 the driver 146 is moved by means of the driver pin 154 down along the detent portion 160 of the guide channel 156.

Simultaneously with this movement of the driver 146 from the fully pushed-in position into the detent position, the energy storage mechanism 144 is charged, i.e. the spring is tensioned.

During pushing-in and during withdrawal of the drawer guide 100 the movement of the driver 146 is substantially independent of the movement of the actuating element 126.

Compared to the drawer guides of prior art, a drawer guide according to the above description enables a larger withdrawal path and/or a higher load.

The invention claimed is:

1. At least three-rail drawer guide for guiding a drawer that can be withdrawn from a carcase, comprising:

an outer rail;

at least one middle rail mounted on rolling bodies;

an inner rail mounted on rolling bodies;

at least one damping apparatus; and a retraction apparatus for automatically retracting the drawer guide from an at least partially withdrawn state into a fully pushed-in state;

wherein:

in the fully pushed-in state of the drawer guide at least one rolling body track of at least one of the at least one middle rail extends at least partially between a damping element of at least one of the at least one damping apparatus and a rolling body track of the inner rail;

the retraction apparatus comprises at least one energy storage mechanism and at least one driver that acts upon the at least one energy storage mechanism; and in the fully pushed-in state of the drawer guide at least one rolling body track of the at least one middle rail extends at least partially between the damping element of at least one of the at least one damping apparatus and a coupling element for coupling the inner rail with the retraction apparatus.

2. Drawer guide according to claim 1, wherein the drawer guide can be disposed completely between a side wall of the carcase and a side wall of the drawer to be withdrawn from the carcase.

3. Drawer guide according to claim 1, wherein in an assembled state of the drawer guide a plane extending substantially vertically and in a withdrawal direction intersects all of the rolling body tracks of the drawer guide and the at least one damping apparatus.

4. Drawer guide according to claim 1, wherein the outer rail, the at least one middle rail and the inner rail have a substantially C-shaped cross section when viewed in a direction at right angles to a withdrawal direction.

5. Drawer guide according to claim 1, wherein an actuating element for actuating the at least one damping apparatus by means of the inner rail is disposed in a withdrawal direction behind the inner rail and, in an assembled state of the drawer guide, extends in a vertical direction over substantially an entire height of the inner rail.

6. Drawer guide according to claim 1, wherein the at least one damping apparatus is disposed at least partially outside of the outer rail, wherein in at least one of the rolling body tracks of the outer rail at least one cut-out is provided, through which extends an actuating element for actuating the at least one damping apparatus.

7. Drawer guide according to claim 6, wherein the actuating element is displaceable along the at least one cut-out.

8. Drawer guide according to claim 1, wherein an actuating element for actuating the at least one damping apparatus by means of the inner rail is provided, which comprises at least one front stop face in a withdrawal direction, which comprises at least one of an elastomer and a thermoplastic material and upon which the inner rail acts in order to actuate the at least one damping apparatus.

9. Drawer guide according to claim 1, wherein the drawer guide comprises a detent apparatus, by means of which the at least one damping apparatus and the inner rail can be releasably coupled to one another.

10. Drawer guide according to claim 9, wherein:

the detent apparatus comprises a damper-side detent element and an inner-rail-side detent element, a detent part of the damper-side detent element interacts with a control curve that is disposed at a side of the detent part remote from the inner-rail-side detent element, and the detent part of the damper-side detent element is movable out of engagement with the inner-rail-side detent element by displacement of the damper-side detent element in a withdrawal direction along the control curve.

11. Drawer guide according to claim 1, wherein the at least one driver and an actuating element for actuating the at least one damping apparatus are configured to be movable relative to one another in a withdrawal direction during at least one of pushing-in and withdrawal of the drawer guide.

12. Drawer guide according to claim 11, wherein during the pushing-in of the drawer guide prior to an unlatching of the at least one driver, the at least one damping apparatus is actuable by means of the inner rail.

13. Drawer guide according to claim 1, wherein the at least one driver and an actuating element for actuating the at least one damping apparatus are configured to be movable relative to one another transversely of a withdrawal direction during pushing-in or during withdrawal of the drawer guide.

14. At least three-rail drawer guide for guiding a drawer that can be withdrawn from a carcase, comprising:

an outer rail;

at least one middle rail mounted on rolling bodies;

an inner rail mounted on rolling bodies;

at least one damping apparatus; and a retraction apparatus for automatically retracting the drawer guide from an at least partially withdrawn state into a fully pushed-in state, the retraction apparatus comprising at least one energy storage mechanism and at least one driver that acts upon the at least one energy storage mechanism;

wherein:

in at least one of the rolling body tracks of the outer rail at least one cut-out is provided, through which extends an actuating element for actuating the at least one damping apparatus, the actuating element comprises at least one front stop face in a withdrawal direction, upon which the inner rail may act with a rear end in the withdrawal direction, the at least one driver and the actuating element are configured to be movable relative to one another in the withdrawal direction during at least one of pushing-in and withdrawal of the drawer guide.

15. Drawer guide according to claim 14, wherein the actuating element is displaceable along the cut-out.

16. Drawer guide according to claim 14, wherein the drawer guide comprises a detent apparatus, by means of which the at least one damping apparatus and the inner rail can be releasably coupled to one another.

17. Drawer guide according to claim 16, wherein:

the detent apparatus comprises a damper-side detent element and an inner-rail-side detent element, a detent part of the damper-side detent element interacts with a control curve that is disposed at a side of the detent part remote from the inner-rail-side detent element, and the detent part of the damper-side detent element is movable out of engagement with the inner-rail-side detent element by displacement of the damper-side detent element in the withdrawal direction along the control curve.

18. Drawer guide according to claim 14, wherein during the pushing-in of the drawer guide prior to an unlatching of the at least one driver, the at least one damping apparatus is actuable by means of the inner rail.

19. Drawer guide according to claim 14, wherein:

the at least one driver and the actuating element for actuating the at least one damping apparatus are configured to be movable relative to one another transversely of the withdrawal direction during pushing-in or during withdrawal of the drawer guide.

* * * * *